United States Patent [19]

Grims

[11] Patent Number: 4,608,843

[45] Date of Patent: Sep. 2, 1986

[54] CONVERSION DIE WITH DOUBLE END SENSOR

[75] Inventor: Conrad M. Grims, Golden, Colo.

[73] Assignee: Adolph Coors Company, Golden, Colo.

[21] Appl. No.: 778,624

[22] Filed: Aug. 23, 1985

Related U.S. Application Data

[63] Continuation of Ser. No. 577,243, Feb. 6, 1984, abandoned.

[51] Int. Cl.[4] ..... B21B 33/02

[52] U.S. Cl. ..... 72/4; 413/56

[58] Field of Search ..... 413/28, 45, 56, 8; 72/4, 26, 444, 12, 360; 209/600, 601

[56] References Cited

FOREIGN PATENT DOCUMENTS 1308641 2/1973 United Kingdom ..... 72/4

*Primary Examiner*—Francis S. Husar
*Assistant Examiner*—Robert Showalter
*Attorney, Agent, or Firm*—Klaas & Law

[57] ABSTRACT

A conversion die for completing can ends having a double can end sensor which senses the presence of a double can and generates a control signal in response thereto which terminates operation of the conversion die.

6 Claims, 11 Drawing Figures

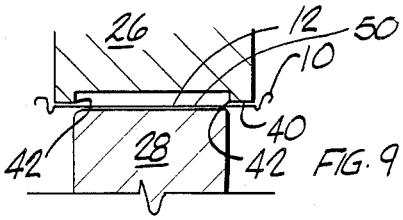
FIG. 9
FIG. 3.
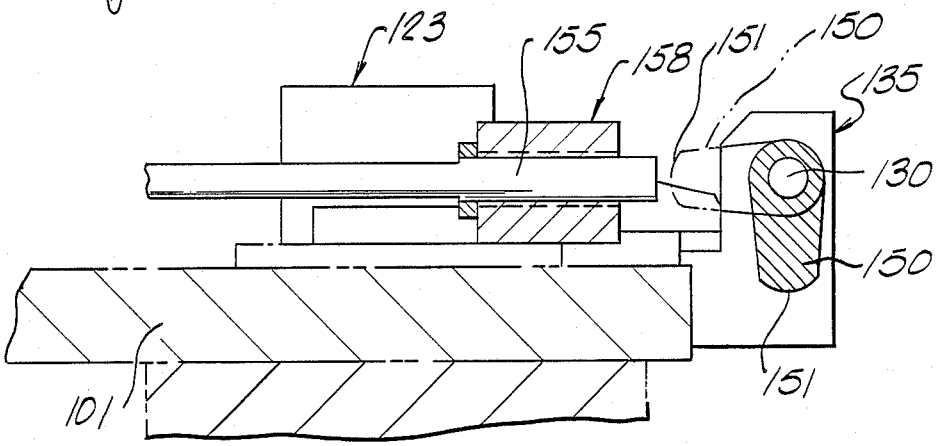
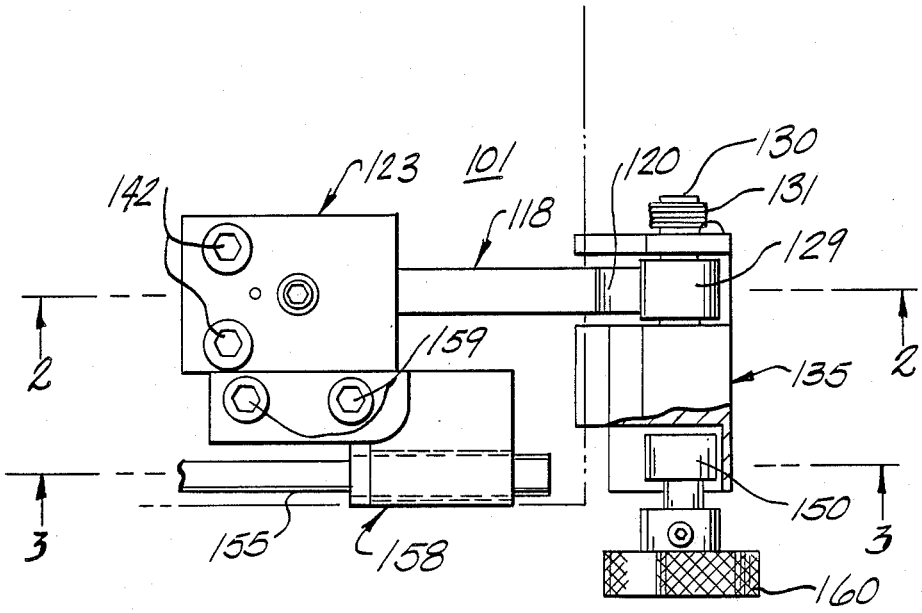
FIG. 1

CONVERSION DIE WITH DOUBLE END SENSOR

This application is a continuation, of application Ser. No. 577,243, filed 2/6/84, now abandoned.

BACKGROUND OF THE INVENTION

The present invention relates to a conversion die for completing can ends such as used on beverage containers and the like, and more particularly to a conversion die having a control apparatus for detecting double can ends and for terminating operation of the conversion die in response to the detection of a double can end.

A conventional conversion die for can ends consists of a number of die-punch machine assemblies positioned at work stations along a machine work path which can ends are caused to follow. The various die-punch machine assemblies perform different operations on a can end as it travels along the work path. For example, one machine assembly may make a groove to provide a weakened zone to form a pop-top opening; another machine assembly may place an identifying mark on the can end. Upon entering the conversion die, a can end has an initially stamped configuration with a generally flat circular body portion; an axially extending rim portion, integrally formed with the circular body portion; a radially extending flange portion, integrally formed and extending radially outwardly from the rim portion; and an arcuate generally axially extending lip portion integrally formed with the flange portion. In operations performed at the various work stations within the conversion die the can end is given the configuration which it will have just prior to being mounted on a can.

The can ends are operated on one at the time at each work station and pass through the machine horizontally in a side-by-side progression. However, the can ends are fed into the conversion die from a feeder in which they are positioned in a vertical stack. Sometimes two can ends which are stacked one on top of the other stick together and enter the conversion die as a "double can end". In most cases a "double can end" is created during an earlier rolling process which forms the arcuate lip portion of the can ends. Lips of two separate ends are occasionally rolled together, thus "locking" the ends together in a coaxial stacked relationship. At other times, a double can end is caused simply by surface adherence of two separate can ends.

When a double can end enters the machine the relatively greater thickness of the double can end may cause damage to some of the operating assemblies within the conversion die. It is thus desirable to detect the presence of a double can end immediately upon entrance thereof into the conversion die, so that operation of the conversion die may be terminated.

SUMMARY OF THE INVENTION

The conversion die of the present invention comprises a specially adapted die-punch assembly which detects the presence of a double can end and terminates the operation of the conversion die in response thereto. The specially adapted die-punch assembly is positioned in the conversion die so as to be the first die-punch assembly receiving a can end which enters the conversion die. The specially adapted die-punch assembly, hereinafter sometimes referred to as the detection die-punch assembly, engages each can end as it passes into the conversion die. The construction of the detection die-punch assembly is such that when a double can end is engaged thereby, the double can end is caused to deform. A specially adapted mechanical linkage is mounted in close proximity to the position occupied by a can end when it is engaged by the detection die-punch assembly. The deformation of a double can end which is caused by engagement with the detection die-punch assembly is sufficient to cause a deflection of the closely positioned mechanical linkage. This deflection of the mechanical linkage is used to actuate a control signal generator which sends a control signal to conventional apparatus to terminate operation of the conversion die. Thereafter, the double can end may be manually removed from the conversion die by a machine operator after which the conversion die is again ready for operation.

In one preferred embodiment of the invention a plunger apparatus is mounted in the center of either the punch or die portion of the die-punch assembly. A recessed portion is provided in the portion of the die-punch assembly containing the plunger and the faces of the punch and die are arranged such that a double can end is caused to buckle or "oil can" into the recessed portion when it is engaged by the detection die-punch assembly. The buckling of the double can end into the recessed portion causes the plunger to be deflected axially in the same direction as the direction of buckling. In one preferred embodiment of the invention, the plunger axial deflection is used to pivot a foot cam which in turn disengages a spring loaded rotating cam sensor. The rotating cam sensor then rotates a quarter of a turn and causes simultaneous rotation of a metallic flag which is fixedly attached to a common shaft with the rotating cam sensor. The quarter turn rotation of the metallic flag places it in close proximity to a metal detector which is actuated by the metal in the metallic flag to send a control signal to a switching apparatus which terminates operation of the machine. Although the plunger apparatus could be positioned in either the punch or die portion of the detection die-punch assembly, in one preferred embodiment, it is positioned in the punch portion. The punch portion is specially adapted to cause buckling of a double can end into a punch recessed area thereof by providing the punch recessed area in a configuration having a larger diameter at a lower portion thereof than in conventional die-punch assemblies. The enlarged lower portion of the recessed area provides a sufficiently large gap in a radially measured direction between the outer radial edge of the associated die and the innermost edge of the lower portion of the recessed portion to allow a double thickness can end to be deflected therebetween to produce an amount of buckling sufficient to displace the mechanical linkage apparatus a predetermined amount.

Thus, a method of detecting a double can end is provided by the apparatus which comprises the steps of engaging a double can end with a die-punch assembly in a manner to cause axial deformation thereof; deflecting a mechanical linkage apparatus in response to the deformation of the double can end; and actuating a signal generator to provide a control signal to terminate operation of the associated convertion die.

BRIEF DESCRIPTION OF THE DRAWINGS

FIG. 1 is a top plan view of a double can end sensor apparatus;

FIG. 3 is a cross-sectional partial elevation view of a double can end detector apparatus;

FIG. 9 is a cross-sectional elevation view of a conventional die-punch assembly;

DETAILED DESCRIPTION OF THE INVENTION

Figure 4:
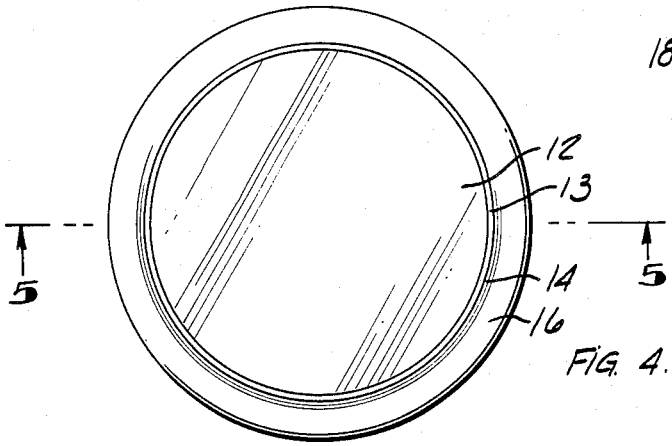
FIG. 4 is a top plan view of a single can end.
Figure 5:
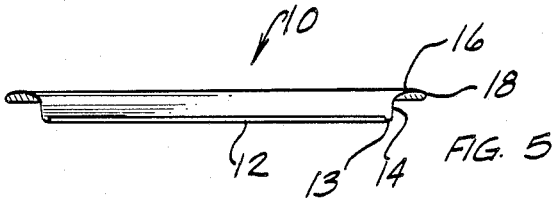
FIG. 5 is a cross-sectional elevation view of a single can end.
Figure 6:
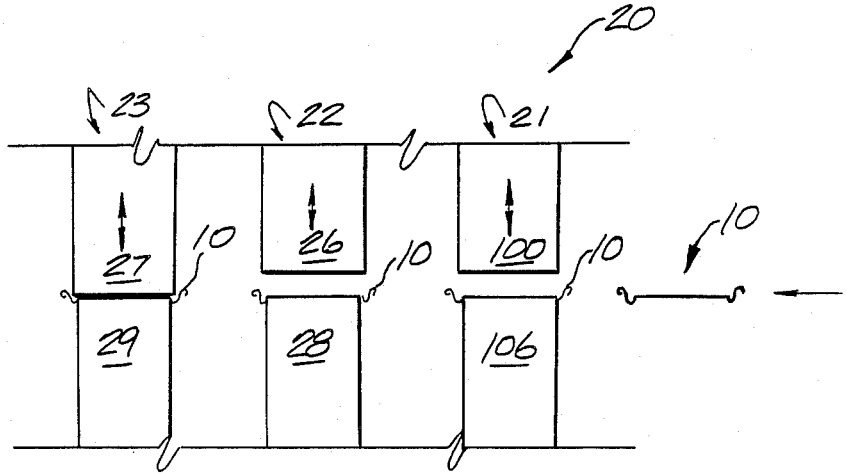
FIG. 6 is a schematic elevation view of a conversion die.

The conversion die 20 of the present invention, illustrating schematically in FIG. 6, is adapted to operate on a can end 10, as illustrated in FIGS. 4 and 5, which has a generally flat, circular body portion 12; an axially extending rim portion 14 integrally connected with the body portion 12 at small radius portion 13, a radially extending flange portion 16 integrally formed with the rim portion 14 and extending radially outwardly therefrom; and an arcuate, generally axially extending, outwardly convex lip portion 18 integrally formed with the flange portion 16.

The conversion die 20 of the present invention comprises a plurality of die-punch assembly work stations 21, 22, 23, etc. as illustrated schematically by FIG. 6. Each work station, in general, comprises a relatively fixed die 28, 29, 106 and a relatively moveable punch 26, 27, 100 axially aligned with the die and axially movable with respect thereto. A can end 10 passing through the conversion die 20 is placed between the punch and die of a work station where it is operated on. Thereafter it is moved to the next succeeding work station by conventional transfer apparatus. The can end 10 is thus moved and operated on from work station to work station until finally leaving the conversion die 20 in a substantially completed form. The operation of a die-punch assembly to perform a forming operation on a can end is well-known in the art. Similarly, the method and structure for moving can ends from a feeder (not shown) through a conversion die is well-known in the art. Therefore, specific structure of the various conversion die components will not be described in detail except those relating to the improvement of the present invention.

Figure 7:
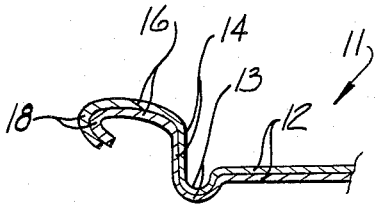
FIG. 7 is a partial cross-sectional elevation view of a double can end.

As shown by FIG. 6, each work station punch is operable between a raised position, (as shown at work station 22, which allows a can end 10 to be inserted or removed from between the punch 26 and die 28) and a lowered position (as shown at work station 23 which enables the punch cutting face on the punch lower surface to perform its intended work task, e.g. forming a groove, etc.). In order for the work task to be performed accurately, the distance between the punch cutting face and the upper surface of the die must be maintained within very close tolerances. A deviation in the thickness of a can end of even a few thousandths of an inch in excess of the can end design thickness may cause severe damage to a die-punch assembly. A double can end 11 such as illustrated by FIG. 7 is of a sufficiently greater thickness than a single can end 10 to cause such damage. In the present invention, apparatus for detection of a double can end is provided at the first station 21 of the conversion die 20.

Figure 2:
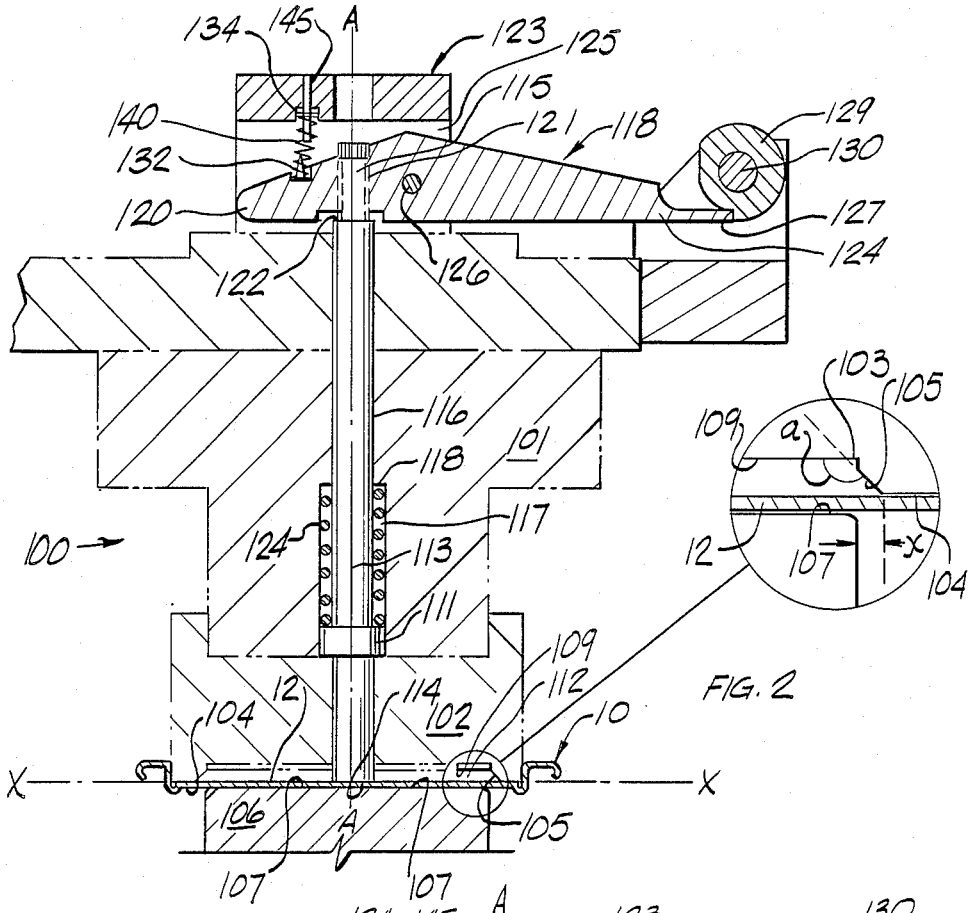
FIG. 2 is a cross-sectional elevation view of a double can end detector apparatus.
Figure 2A:
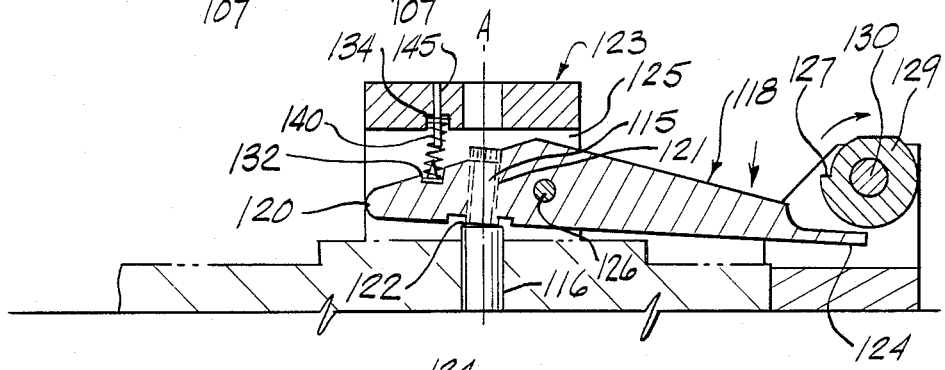
FIG. 2A is a partial cross-sectional elevation view of the portion of a double can end detector apparatus shown in FIG. 2 in a different operating position.
Figure 2A:
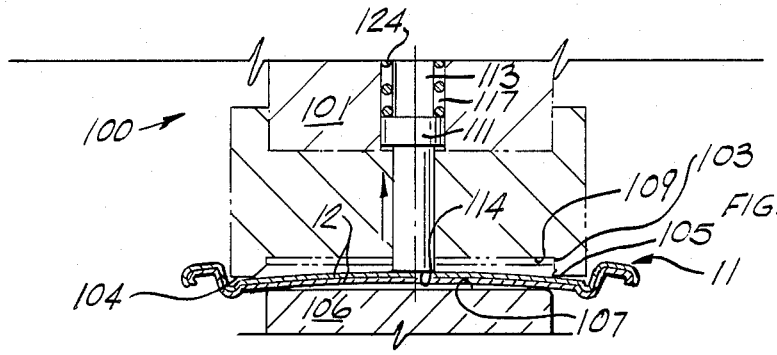

When a can end enters the conversion die after leaving the feeder (not shown), it first passes through detection die-punch assembly 21, FIG. 6, as shown in greater detail in FIG. 2. The punch 100 comprises a punch block 101 and a lower fixed end fitting 102 having a lower surface 104, which engages the upper surface of a can end to be operated on. Fitting 102 may be press-fitted or otherwise conventionally attached to block 101. The punch 100 moves up and down with respect to a fixed die 106. The illustrations of FIGS. 2 and 2A show the punch in a lowered, can end engaging position. The relatively fixed die 106 has a center line co-axial with that of the punch 100 (Axis AA) and is adapted to support a can end 10, on its upper surface 107. A centrally positioned cutout portion 112, having horizontal wall 109, vertical wall 103 and tapered wall 105, is provided at the lower end of the punch end piece 102 in axially upwardly recessed relationship with a punch planar peripheral lower surface 104. During normal operations the upper surface of a can end body portion 12 is contacted by punch lower surface 104 when the punch 100 is in the lowered position, shown in FIG. 2.

A plunger shaft 113 is provided in axially movable relationship within a centrally positioned bore portion 116 in the punch block 101. The plunger 113 is biased in a downward position by a compression spring 124. Compression spring 24 is mounted about plunger 113 within enlarged bore portion 117 engaging a bore shoulder portion 118 at one end thereof and plunger fixedly attached ring 111 at the other end thereof. Thus, plunger 113 remains in the position illustrated by FIG. 2 until being urged upwardly by an object contacting its lower end 114. A conventional screw adjustment 115, as described in further detail below, may be provided in contact with the upper end of the plunger for adjusting the position of the plunger lower end 114 to align it with a plane XX defined by lower punch surface 104. Thus, the lower terminal end 114 of plunger shaft 113 which is positioned in alignment with surface 104 may be lightly contacted by the surface of a single can end 10, but is not moved upwardly thereby. However, as shown in FIG. 2A, when a double can end 11 is pressed between the upper surface 107 of the die portion 106 and the lower surface 104 of punch 100, the greater thickness of the double end and the geometric configuration of recess 112 cause the double end to buckle upwardly into recess 112, thereby driving plunger shaft 13 upwardly.

Figure 8:
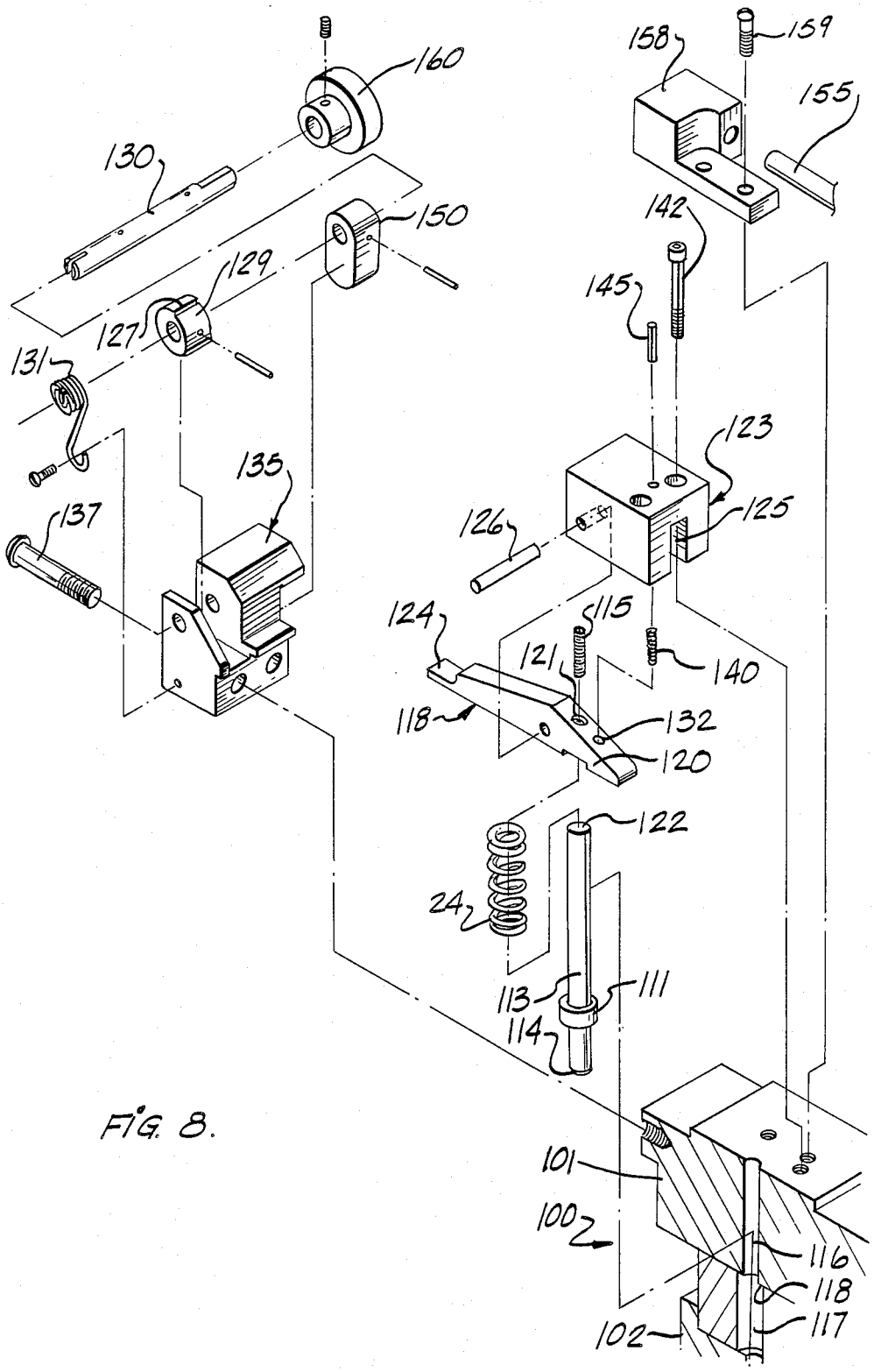
FIG. 8 is an exploded perspective view of a double can end detector apparatus.

A foot cam 118, FIGS. 2, 2A and 8, is provided which comprises a lever arm pivoted about a pin 126 which is mounted in a hollow block 123 fixedly mounted to an upper surface of punch block 101, as by bolts 142. A slot 125 is provided in the block 123 to allow foot cam 118 to pivot. The foot cam 118 has one end 120 adapted, as by contact with screw 115 threadingly mounted in foot cam bore 121, to engage an upper surface portion 122 of the plunger 113. The foot cam has a second end 124 which engages a shoulder portion 127 of a cam sensor 129 peripheral surface. The cam sensor 129 is fixedly mounted on a central shaft 130, which is rotatably mounted on a spacer 135 block which is in turn rigidly attached, as by bolt 137, to block 101. The cam sensor 129 is biased, as by torsion spring 131, FIG. 8, to rotate in a clockwise direction, with reference to FIGS. 2 and 2A, and such clockwise rotation is resisted by end 124 of foot cam 118, FIG. 2. Foot cam end 124 is biased in this locking relationship with cam sensor shoulder portion 127 by a coil spring 140, mounted between a notch and nipple portion 132 in foot cam first end 120 and a notch 134 in hollowed-out block 123. Spring 140 may be further retained in position by a pin 145 insertable through a hole in the top of the block 123 in co-axial relationship with the compression spring 140 and notch 134.

As shown by FIG. 2A, upward motion of the plunger 113, caused by buckling of a double can end 11, moves foot cam end 120 upwardly, overcoming the biasing force of spring 140 and causing foot cam end 124 to be deflected downwardly. Downward movement of end 124 causes rotatable cam sensor 129 to be released. Cam sensor 129 and shaft 130 then rotate approximately 90° in a clockwise direction. The rotation of shaft 130 causes a small metallic flag block 150 which is affixed to shaft 130 to also rotate a quarter of a turn. As illustrated in FIG. 3; the rotation of the flag block 150 may be from the position shown in solid lines to the position shown in phantom lines. In the position illustrated in the phantom lines, the radially most remote end 151 of metallic flag block 150 is positioned directly opposite a conventional metal sensor 155 which may be mounted in sensor block 158 fixedly mounted as by bolts 159 to block 101. Sensor 155, immediately upon detecting the presence of the metal in flag block 150, sends a control signal to a conventional switching assembly which terminates operation of the conversion die. The double can end is then manually removed from the conversion die and the cam sensor 129 is reset manually to the position illustrated in FIG. 2 as by use of knob 160, fixedly attached to shaft 130.

The relationship of a single can end 10 to the surfaces of a conventional punch and die assembly are illustrated by FIG. 9. It can be seen that in this arrangement that lower planar peripheral surface 40 of the punch 26 engages the upper surface of can body portion 12 near its periphery and the upper surface 50 of die 28 engages the lower surface of the can end body portion 12 immediately radially inwardly of the radially innermost edge portion 42 of surface 40. It was found that a double can end in encountering such a die-punch surface configuration did not, in most cases, buckle upwardly a significant distance above a plane defined by surface 40. Thus, the above-described plunger and cam arrangement could not be used to terminate operation of the machine because a plunger would not be deflected by a double end engaged in a conventional punch and die assembly. However, it was discovered that sufficient buckling of a double can end could be produced by a surface arrangement of the type shown in FIG. 2 in which a sidewall 105 of punch cutout 112 is bevelled downwardly and outwardly at an angle "a" with the recess 112 upper horizontal surface 109 of at least 120° and preferably 135°. The radially measured gap "x" between the outer circumference of surface 107 and the inner circumference of surface 104 must be at least twice the thickness of a single can end body portion and is preferably 0.10 inches to allow the desired buckling of a double can end. The desired amount of buckling measured axially at the center point of a double can end is preferably a distance of at least 0.010 inches.

Thus, it may be seen that a conversion die 20 is provided which utilizes a modified work station to detect the presence of a double can end. A control signal is generated in response to detection of a double can end to terminate operation of the machine before the double can end causes damage to any of the die-punch assemblies therein. An operator may thereafter remove the double can end, reset the detection apparatus and return the conversion die to operation within a few minutes.

Figure 10:
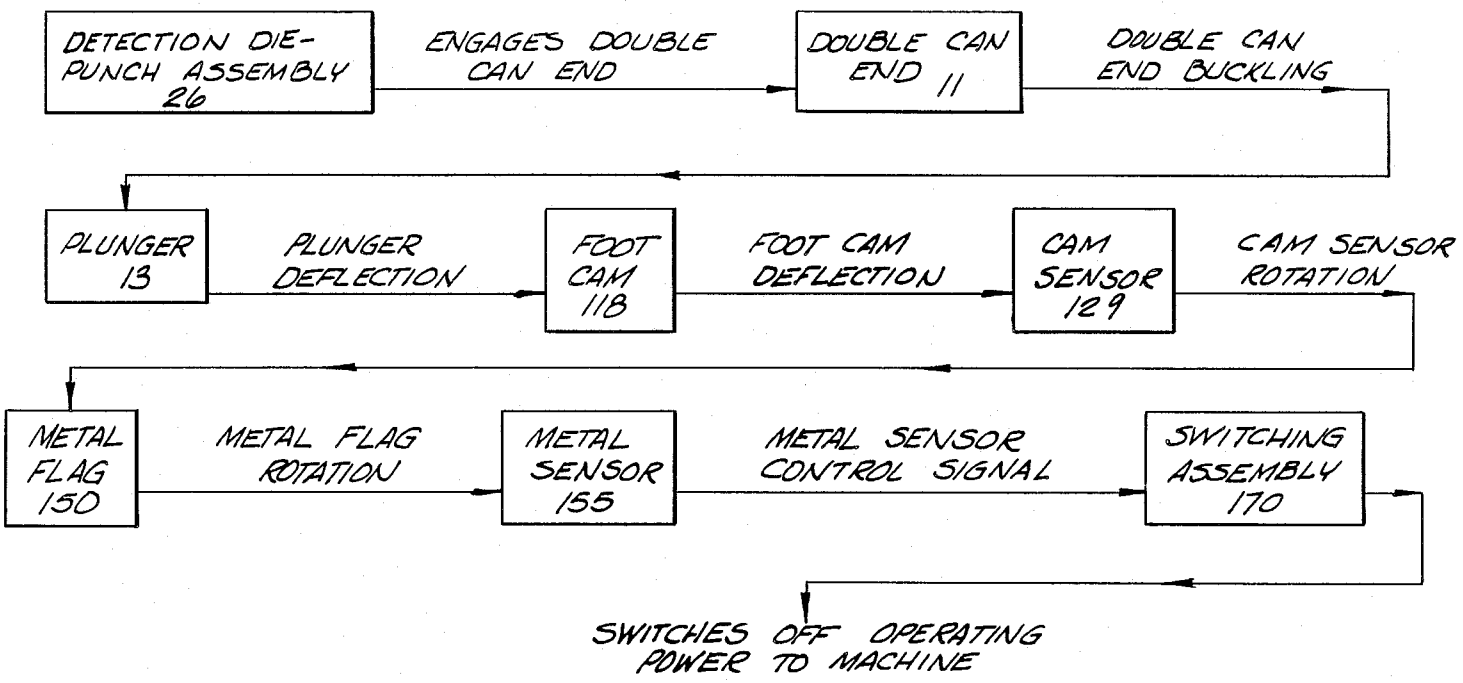
FIG. 10 is a schematic diagram showing the operation of various structural assemblies used in detecting a double can end and terminating operation of a conversion die response thereto.

The sequence of operations performed by the conversion die in response to the entry of a double can end into the machine is shown schmematically in FIG. 10. The detection die-punch assembly 21 engages a double can end 11 causing the double can end to buckle upwardly. The upward buckling of the double can end causes plunger 113 to be engaged thereby and deflected upwardly. Upward deflection of the plunger 113 pivots foot cam 118 causing cam sensor 129 to be disengaged from its locked position. Cam sensor 129 then rotates with associated shaft 130 causing attached metal flag 150 to be deflected into a position where it is sensed by metal detector 155. Metal detector 155 then sends a control signal to a conventional switching assembly 170 which shuts off power to the machine. The double end is then manually discarded, the cam sensor 129 is reset and the machine is again switched on.

It is contemplated that the inventive concepts herein described may be variously otherwise embodied and it is intended that the appended claims be construed to include alternative embodiments of the invention except insofar as limted by the prior art.

What is claimed is:

1. A method of controlling a conversion die of the type used to perform operations on can ends to prevent damage from double can ends comprising the steps of:

(a) engaging a double can end between a punch and die in a manner to cause buckling thereof;

(b) axially deflecting a plunger in response to the buckling of the double can end;

(c) pivoting a foot cam in response to the plunger deflection;

(d) disengaging and rotating a spring loaded cam sensor in response to the pivoting of the foot cam;

(e) rotating a metal flag with the cam sensor between a first position and a second position;

(f) actuating a control signal generator in response to movement of the metal flag into the second position; and (g) terminating operation of the conversion die in response to a signal generated by actuation of the control signal generator.

2. A detection apparatus for detecting the presence of double can ends of the type comprising two single can ends stacked one on top the other, the single can ends having at least a body portion, a rim portion and a flange portion, the apparatus comprising:

a die punch assembly including a first relatively fixed die means for supporting a can end thereon and a relatively movable punch means positioned opposite and being reciprocally movable with respect to said die means for engaging a portion of a can end supported on said die means;

a central recessed portion in one of said punch means and said die means positioned immediately next adjacent an opposite surface of a body portion of a can end engaged by said die means adapted to receive a buckling central portion of a double can end therewithin;

mechanically deflectable means extending into said recessed portion for movement between a first normal position associated with engagement of a single can end and a second deflected position associated with engagement of a double can end having a portion thereof buckled into said recessed portion;

signal generating means actuated by movement of said mechanically deflectable means into said deflected position for generating a control signal terminating operation of an associated conversion die;

wherein said mechanically deflectable means comprises plunger means extending into said recessed portion for transferring linear movement associated with buckling of a double can end and cam means operatively associated with said plunger means for pivotal movement in response to said linear movement of said plunger means.

3. The invention of claim 2 wherein said mechanically deflectable means further comprises spring biased cam detector means operatively associated with said cam means for producing rotational movement in response to displacement of said cam means.

4. A detection apparatus for detecting the presence of double can ends of the type comprising two single can ends stacked one on top the other, the single can ends having at least a body portion, a rim portion and a flange portion, the apparatus comprising:

a die punch assembly including a first relatively fixed die means for supporting a can end thereon and a relatively movable punch means positioned opposite and being reciprocally movable with respect to said die means for engaging a portion of a can end supported on said die means;

a central recessed portion in one of said punch means and said die means positioned immediately next adjacent an opposite surface of a body portion of a can end engaged by said die means adapted to receive a buckling central portion of a double can end therewithin;

mechanically deflectable means extending into said recessed portion for movement between a first normal position associated with engagement of a single can end and a second deflected portion associated with engagement of a double can end having a portion thereof buckled into said recessed portion;

signal generating means actuated by movement of said mechanically deflectable means into said deflected position for generating a control signal terminating operation of an associated conversion die;

wherein said mechanically deflectable means comprises:

a plunger means for engagement with a double can end and linearly displaceable in response to buckling thereof between a first normal position and a second deflected position associated with buckling of the double can end;

a cam means operably associated with said plunger means for pivotal movement between a first cam position associated with said first plunger position and a second cam position associated with said second plunger position;

a cam detector means operably associated with said cam means for rotation between a first position associated with said first cam positioned and a second position associated with said second cam position;

a flag means mounted on a common shaft with said cam detector means for rotation therewith between a first position associated with said cam detector means first position and a second position associated with said second cam position, said first flag position being in non-actuating relationship with said signal generating means, said second flag position being in actuating relationship with said signal generating means.

5. A double can end detection apparatus for detecting the presence of a double can end of the type comprising two single can ends stacked one on top the other in parallel concentric alignment for use in association with a conversion die for performing a plurality of work operations on a single can end blank of the type having a generally flat, circular, radially extending body portion; an axially extending rim portion integrally formed with the body portion; a radially extending flange portion integrally formed with the rim portion; and an arcuate, generally axially extending, lip portion integrally formed having a recessed portion extending upwardly from said punch lower surface for providing a deflection zone into which a portion of a double can end buckles when the double can end is engaged by said punch lower surface;

plunger means operably received within a bore in said punch means and extending generally perpendicular to said detection punch means lower surface, said punch means being extendible into said detection punch means recessed portion and being movable between a first plunger position wherein a bottom surface of said plunger means is positioned in substantially coplanar relationship with said lower surface of said detection punch means and a second plunger position in substantially upwardly displaced relationship from said first plunger position;

coil spring means for biasing said plunger in said first position, positioned in concentric relationship with said plunger means and within said bore portion of said detection punch means said coil spring means being engaged at one end by a surface portion of said plunger means and at the other end by a shoulder portion in said bore in said punch means;

cam means for actuating a rotatable cam sensor means, said cam means being pivotally mounted on an upper portion of said detection punch means and having a first end engageable with an upper portion of said plunger means and a second end engageable with said rotatable cam sensor means, said cam being deflectable between a first position in engaging contact with said rotatable cam sensor means and a second position in disengaged relationship with said rotatable cam sensor means;

cam spring biasing means operatively associated with said cam means for biasing said cam means in said first cam position;

rotatable cam sensor means mounted on a shaft rotatably attached to an upper portion of said detection punch means for rotating between a first position in engaged relationship with said cam means and a second position rotated substantially 90 degrees from said first position;

rotatable cam sensor biasing means operatively associated with said rotatable cam sensor for biasing said rotatable cam sensor in said second position;

metal flag means for actuating a metal detector means mounted on said shaft and projecting radially outwardly therefrom said flag means being rotatable between a first position associated with said first position of said rotatable cam sensor means in which said flag means is in non-detectable relationship with a metal detector means and an second position associated with said second position of said rotatable cam sensor means in which said flag means is detectable by said metal detector means; and metal detector means for detecting said flag in said second flag position and for sending a control signal in response thereto for terminating operation of said conversion die.

6. A conversion die apparatus for performing a plurality of work operations on a can end blank of the type having a generally flat, circular, radially extending, body portion; an axially extending rim portion integrally formed with the body portion; a radially extending flange portion integrally formed with the rim portion; and an arcuate, generally axially extending, lip portion integrally formed with the flange portion, comprising:

(a) a plurality of work stations for performing said plurality of work operations on can ends passing therethrough, at least one of said work stations comprising:

a work die having an upper surface adapted for supporting a lower surface of a can end body portion thereon;

a work punch positioned opposite the work die movable in a direction perpendicular to the surface of the can end body portion supported by said work die between a first position in spaced apart relationship from a can end positioned on the work die and a second position;

wherein a face portion of the punch deformably engages an area of the central body portion of the can end mounted on the work die to produce a predetermined deformation thereon; and (b) a double can end detection apparatus for detecting the presence of a double can end of the type comprising two single can ends stacked one on top the other in parallel concentric alignment comprising:

fixed detection die means, for periodically supporting a can end, having a substantially flat upper surface thereon of smaller diameter than the body portion of a can end to be supported thereon;

detection punch means positioned opposite said fixed detection die means and having a substantially planar punch lower surface for engaging a peripheral portion of a body portion of a can end supported on said detection die means and having a recessed portion extending upwardly from said punch lower surface for providing a deflection zone into which a portion of a double can end buckles when the double can end is engaged by said punch lower surface;

plunger means operably received within a bore in said punch means and extending generally perpendicular to said detection punch means lower surface, said punch means being extendible into said detection punch means recessed portion and being movable between a first plunger position wherein a bottom surface of said plunger means is positioned in substantially coplanar relationship with said lower surface of said detection punch means and a second plunger position in substantially upwardly displaced relationship from said first plunger position;

coil spring means for biasing said plunger in said first position, positioned in concentric relationship with said plunger means and within said bore portion of said detection punch means said coil spring means being engaged at one end by a surface portion of said plunger means and at the other end by a shoulder portion in said bore in said punch means;

cam means for actuating a rotatable cam sensor means, said cam means being pivotally mounted on an upper portion of said detection punch means and having a first end engageable with an upper portion of said plunger means and a second end engageable with said rotatable cam sensor means said cam being deflectable between a first position in engaging contact with said rotatable cam sensor means and a second position in disengaged relationship with said rotatable cam sensor means;

cam spring biasing means operatively associated with said cam means for biasing said cam means in said first cam position;

rotatable cam sensor means mounted on a shaft rotatably attached to an upper portion of said detection punch means for rotating between a first position in engaged relationship with said cam means and a second position rotated substantially 90 degrees from said first position;

rotatable cam sensor biasing means for biasing said rotatable cam sensor in said second position;

metal flag means for actuating a metal detector means mounted on said shaft and projecting radially outwardly therefrom said flag means being rotatable between a first position associated with said first position of said rotatable cam sensor means in which said flag means is in non-detectable relationship with a metal detector means and an second position associated with said second position of said rotatable cam sensor means in which said flag means is detectable by said metal detector means; and metal detector means positioned proximate said flag means for detecting said flag means in said second flag position and for sending a control signal in response thereto for terminating operation of said conversion die.

* * * * *